United States Patent [19]

Dodo et al.

[11] 3,980,572

[45] Sept. 14, 1976

[54] GREASE COMPOSITION

[75] Inventors: Toshinori Dodo; Makoto Ikeda, both of Ichihara, Japan

[73] Assignee: Idemitsu Kosan Co., Ltd., Tokyo, Japan

[22] Filed: July 28, 1975

[21] Appl. No.: 599,340

[30] Foreign Application Priority Data

July 31, 1974 Japan ..... 49-87031

[52] U.S. Cl. ..... 252/36; 252/41

[51] Int. Cl.[2] ..... C10M 1/24; C10M 3/18; C10M 5/14; C10M 7/20

[58] Field of Search ..... 252/36, 41

[56] References Cited

UNITED STATES PATENTS

| | | | |
|---|---|---|---|
| 2,477,296 | 7/1949 | Georgi | 252/36 |
| 2,842,493 | 7/1958 | Butcosk | 252/36 |
| 2,883,341 | 4/1959 | Allison | 252/36 |
| 3,014,867 | 12/1961 | Fronczak | 252/41 |
| 3,053,767 | 9/1962 | Hallowell | 252/41 |
| 3,389,084 | 6/1968 | Bartlett et al. | 252/41 |
| 3,475,336 | 10/1969 | Cross | 252/41 |

*Primary Examiner*—Delbert E. Gantz
*Assistant Examiner*—I. Vaughn
*Attorney, Agent, or Firm*—Woodhams, Blanchard and Flynn

[57] ABSTRACT

A lubricating grease composition consisting of lubricating base oil comprising lithium salt of a blended fatty acid prepared by mixing (a) 5 to 15 % by weight, based on the weight of the lubricating grease composition, of a natural fatty acid selected from the group consisting of stearic acid and 12-hydroxystearic acid with (b) a mixture of synthetic fatty acids having 8 to 24 carbon atoms in an amount of 0.5 to 50 % by weight, based on the weight of said natural fatty acid, is superior in roll stability in the presence of water as well as thermal stability.

7 Claims, No Drawings

GREASE COMPOSITION

BACKGROUND OF THE INVENTION

The present invention relates to a novel lubricating grease composition improved in roll stability in the presence of water as well as thermal stability. Conventional grease compositions have failed to display a satisfactory roll stability for practical use in the presence of water, and therefore, various studies have hitherto been made with a view to overcoming this drawback.

As the means proposed for this purpose, there is, for instance, a method wherein some animal fat is mixed with grease. However, this method is defective in that the animal fat is instable so that it is apt to be transformed to fatty acid and glycerin, causing softening of the grease during the use thereof. Application of such additives as lead naphthenate and zinc rosinate has also been studied, but all these additives have fallen short of being completely effective. To cite other well-known greases effective from the view point of roll stability in the presence of water, there are a grease comprising a lithium soap consisting of wool fatty acid, stearic acid and hydroxy acid at a well-balanced compounding ratio together with a soap of Ba, Ca, Sr or the like (as disclosed in Japanese Patent Publication No. 17136/1960) and a lithium grease prepared by combining epoxide fatty acid with saturated fatty acid (as disclosed in Japanese Patent Publication No. 5172/1964). And, to cite well-known additives to serve for improvement of said stability, there are such ones as an additive comprising polyalkylene oxide-containing polyether polyole (as disclosed in Japanese Patent Publication No. 28108/1964) and an additive comprising alkoxylated alkyl phenol (as disclosed in U.S. Pat. No. 380156).

SUMMARY OF THE INVENTION

The present inventors have made a series of studies with a view to improving the roll stability in the presence of water as well as the thermal stability (variability of cone penetration due to high temperature) of grease compositions and have come to develop a novel lubricating grease composition.

A lubricating grease composition according to the present invention consists of a lubricating base oil for the most part thereof and a lithium salt of blended fatty acid prepared by mixing (a) 5 to 15 % by weight, based on the weight of the lubricating grease composition, of a natural fatty acid selected from the group consisting of stearic acid and 12-hydroxystearic acid with (b) a mixture of synthetic fatty acids having 8 to 24 carbon atoms in an amount of 0.5 to 50 % by weight, based on the weight of said natural fatty acid. A lubricating grease composition according to the present invention may be further admixed with 0.5 to 5 % (by weight) of aluminum stearate. In either case, the lubricating grease composition under the present invention, compared with conventional lithium greases, is remarkable in the variation of cone penetration pursuant to change of temperature and displays an excellent roll stability even in the presence of water.

DESCRIPTION OF THE PREFERRED EMBODIMENTS

As the lubricating base oil for use in the present invention, any mineral oil subjected to solvent extraction, hydrocracking, hydrofinishing or like processes is applicable. The applicable lubricating base oils include the following:

a. 150 neutral oil obtained by subjecting paraffinic mineral oil to hydrocracking
b. 500 neutral oil obtained by subjecting paraffinic mineral oil to hydrocracking
c. bright stock obtained by subjecting paraffinic mineral oil to hydrocracking
d. 500 neutral oil obtained by subjecting naphthenic mineral oil to hydrofinishing
e. 30 motor oil obtained by subjecting naphthenic mineral oil to acid refining.

The properties of these lubricating base oils are as shown in the following Table-1.

Table 1

| Properties | Kind of Base Oil | | | | |
|---|---|---|---|---|---|
| | a | b | c | d | e |
| specific gravity 15/4 °C (JIS K2249) | 0.8680 | 0.8746 | 0.8836 | 0.8991 | 0.9531 |
| color (AST MD-1500) | L1.0 | L2.0 | L3.5 | L0.5 | L4.5 |
| flash point (JIS K2274) | 216 | 274 | 326 | 222 | 228 |
| viscosity cSt (JIS K2283) | | | | | |
| at 37.8 °C | 32.03 | 107.7 | 467.7 | 110.6 | 302.4 |
| at 98.9 °C | 5.211 | 11.87 | 31.9 | 9.313 | 13.11 |
| viscosity index (JIS K2284) | 102 | 108 | 107 | 52 | −32 |
| pour point (JIS K2269) | −20.0 | −17.5 | −12.5 | −30 | −15 |
| total acid value (JIS K2501) | 0.01 | 0.01 | 0.01 | 0.01 | 0.01 |

In addition to the foregoing, the well-known synthetic lubricating oils such as diester oil (e.g., 2-ethyl hexyl sebacate), silicone oil (e.g., polymethyl phenyl siloxane), fluorocarbon oil, and ucon oil (e.g., polyalkylene glycol) can also be applied as occasion demands.

As the natural fatty acid for use in the present invention, stearic acid and/or 12-hydroxystearic acid are applicable. The amount of these fatty acids to be employed is from 5 to 15 % by weight of the whole amount of the grease composition.

As the mixture of synthetic fatty acids for use in the present invention, any mixture of synthetic fatty acids having 8 to 24 carbon atoms prepared by the normal paraffin oxidation process and other known processes is applicable, and typical mixtures of synthetic fatty acids to be applied are as cited in the following Table-2.

Table 2

| Number of Carbon Atoms | Distribution of Number of Carbon Atoms in Synthetic Fatty Acid (%) | | | |
|---|---|---|---|---|
| | (A) | (B) | (C) | (D) |
| 8 | 0.4 | | | 0.2 |
| 9 | 0.6 | | | 1.4 |
| 10 | 13.1 | 0.6 | 0.6 | 2.5 |
| 11 | 35.9 | 5.4 | 1.5 | 1.4 |
| 12 | 28.2 | 16.0 | 3.0 | 6.0 |
| 13 | 15.0 | 23.0 | 5.1 | 7.2 |
| 14 | 5.1 | 22.8 | 5.5 | 8.0 |
| 15 | 1.3 | 17.6 | 7.5 | 8.0 |
| 16 | 0.4 | 9.9 | 9.0 | 8.0 |
| 17 | | 3.6 | 10.5 | 8.6 |
| 18 | | 1.0 | 11.8 | 8.6 |
| 19 | | 0.4 | 12.0 | 9.6 |
| 20 | | | 11.3 | 9.4 |
| 21 | | | 10.9 | 8.0 |
| 22 | | | 9.0 | 5.7 |
| 23 | | | 1.0 | 4.2 |

Table 2-continued

| Number of Carbon Atoms | Distribution of Number of Carbon Atoms in Synthetic Fatty Acid (%) | | | |
|---|---|---|---|---|
| | (A) | (B) | (C) | (D) |
| 24 or more | | | 1.3 | 3.2 |
| iodine number | 7.6 | 9.1 | 27.0 | 15~18 |
| total acid value | 285 | 271 | 130 | 30~50 |
| saponification value | 294 | 273 | 172 | 120~150 |
| hydroxyl value | 34.1 | 25.3 | 10.7 | |

In the present invention, said mixture of synthetic fatty acids having 8 to 24 carbon atoms is applied to the extent of from 0.5 to 50 % — preferably from 15 to 20 % — on the basis of the weight of said natural fatty acid. For the purpose of saponification of the natural fatty acid and synthetic fatty acid, $LiOH.H_2O$ is normally employed, but lithium carbonate is also applicable.

A lubricating grease composition according to the present invention which consists of lithium salt of a blended fatty acid prepared by mixing a natural fatty acid with a mixture of synthetic fatty acids and lubricating base oil can be further improved in respect of the roll stability in the presence of water and the relationship between the temperature and the cone penetration thereof when aluminum stearate is added thereto to the extent of from 0.5 to 5 % (by weight) — preferably 2.0 % (by weight). Besides, the present grease composition can of course be admixed with well-known lubricating oil additives as occasion demands.

The method of manufacturing a lubricating grease composition according to the present invention is, for instance, as follows. That is, a predetermined amount of a mixture of the natural fatty acid and the mixture of synthetic fatty acids is dissolved in a portion of the lubricating base oil and is heated. Upon raising the temperature of the thus processed mixture up to about 90°C, a 20 % solution of lithium hydroxide is added thereto. Then, while heating and stirring the mixture, the remaining lubricating base oil is added thereupon raising the temperature of the mixture up to 120°C, and the heating is further applied to raise the temperature to 205°C. Subsequently, by defoaming after cooling, a grease composition under the present invention is obtained.

EXAMPLES I – IV

Varieties of grease compositions were prepared by the above described method of manufacture by employing lubricating base oils (mineral oils) and synthetic fatty acids listed in the foregoing Table-1 and Table-2, and their properties were evaluated. The compositions and properties of the respective greases were as shown in the following Table-3.

Table 3

| | | Example I | Example II | Example III | Example IV | Comparative grease composition A |
|---|---|---|---|---|---|---|
| Compounding ratio % (by weight) | mineral oil b | 78.9 | 78.81 | 78.04 | — | |
| | mineral oil e | — | — | — | 77.10 | |
| | stearic acid | 15.0 | 15.0 | 15.0 | 10.0 | |
| | synthetic fatty acid (A) | 3.0 | — | — | — | |
| | synthetic fatty acid (B) | — | 3.0 | — | — | |
| | synthetic fatty acid (C) | — | — | 3.0 | — | |
| | synthetic fatty acid (D) | — | — | — | 10.0 | |
| | lithium hydroxide | 3.10 | 3.09 | 2.96 | 2.90 | |
| Properties: | | | | | | |
| cone penetration 25°C(UW) (JIS K2560) | | 224 | 240 | 230 | 223 | 269 |
| dropping point °C (JIS K2561) | | 209 | 208 | 209 | 162 | 201 |
| oil separation (JIS K2570) | | 4.4 | 4.3 | 0.5 | 3.2 | 3.3 |
| roll stability in the presence of water (AST MD1831) | | +87 | +75 | +20 | +92 | +100 |
| variability of cone penetration according to temperature (JIS K2560) | | | | | | |
| 100°C × 3Hr·UW | | +109 | +93 | +14 | +42 | +108 |
| 150°C × 3Hr·UW | | +127 | +75 | +54 | +62 | +148 |

As is clear from Table-3 above, compared with the comparative grease composition A (a commercial lithium grease comprising stearic acid), grease compositions prepared by jointly employing stearic acid and a mixture of synthetic fatty acids are improved in roll stability in the presence of water. Particularly in the case of grease compositions employing synthetic fatty acid (C), the rate of increase of cone penetration with rise in temperature is low.

EXAMPLES V – X

By setting the compounding ratio of synthetic fatty acid (C) to stearic acid at about 5%, about 10%, about 15%, about 20%, about 30% and about 40%, respectively, varieties of grease compositions were prepared in the same way as in the preceding examples. The properties of the resultant grease compositions were as shown in the following Table-4.

Table 4

| | | Example V | Example VI | Example VII | Example VIII | Example IX | Example X |
|---|---|---|---|---|---|---|---|
| | Synthetic fatty acid (C) | about 5% | about 10% | about 15% | about 20% | about 30% | about 40% |
| Compounding ratio % (by weight) | mineral oil b | 84.93 | 84.94 | 84.95 | 84.95 | 84.97 | 84.97 |
| | stearic acid | 12.3 | 11.7 | 11.1 | 10.4 | 11.7 | 5.2 |
| | synthetic fatty acid (C) | 0.7 | 1.3 | 1.9 | 2.6 | 3.9 | 7.8 |
| | lithium hydroxide | 2.07 | 2.06 | 2.05 | 2.05 | 2.03 | 2.03 |
| Properties: | | | | | | | |
| cone penetration 25°C (UW) (JIS K2560) | | 262 | 232 | 229 | 224 | 220 | 212 |
| dropping point (JIS K2561) | | 201 | 200 | 202 | 202 | 200 | 200 |
| oil separation (JIS K2570) | | 3.1 | 2.5 | 3.0 | 3.2 | 3.2 | 3.0 |
| roll stability in the presence of water (AST MD1831) | | +88 | +62 | +34 | +32 | +60 | +74 |
| variability of cone penetration according to temperature (JIS K2560) | | | | | | | |
| 130°C × 3Hr·UW | | +56 | +58 | +46 | +40 | +28 | +26 |
| 150°C × 3Hr·UW | | +70 | +67 | +54 | +40 | +23 | +20 |

The above Table-4 verifies that the compounding ratio of synthetic acid to stearic acid is desirable to be in the range of from about 15 to about 20% for the purpose of improving the roll stability in the presence of water of grease compositions. Besides, it has been confirmed that in the case where the compounding ratio of synthetic fatty acid to stearic acid is more than 55%, there is formed granular soap in the course of saponification, and this granular soap would become liquid without taking the form of grease when subjected to milling.

EXAMPLES XI – XIV

Varieties of grease compositions were prepared in the same way as in the preceding Examples V – X except for the employment of 12-hydroxystearic acid in place of stearic acid, and their properties were evaluated. The results were as shown in the following Table-5.

As shown in the above Table-5, compared with the comparative grease composition B (a commercial lithium grease containing 12-hydroxystearic acid), grease compositions prepared by jointly employing 12-hydroxystearic acid and a mixture of synthetic fatty acids retain a satisfactory roll stability in the presence of water as well as relationship between the temperature and the cone penetration. In the case of employing 12-hydroxystearic acid as the natural fatty acid, the amount of the synthetic fatty acid to be applied is desirable to be in the range of from about 20 to about 30% relative to the natural fatty acid particularly from the view point of the roll stability in the presence of water of the resulting grease composition.

EXAMPLES XV – XVI

To verify the effect of aluminum stearate upon grease composition, a variety of greases having such compositions as shown in the following Table-6 were prepared and their properties were evaluated.

Table 5

| | | Example XI | Example XII | Example XIII | Example XIV | Comparative grease Composition B |
|---|---|---|---|---|---|---|
| | Synthetic fatty acid | about 10% | about 20% | about 25% | about 30% | |
| Compounding ratio % (by weight) | mineral oil b | 88.46 | 88.43 | 86.16 | 88.41 | |
| | 12-hydroxystearic acid | 9.0 | 8.0 | 9.0 | 7.0 | |
| | synthetic fatty acid (C) | 1.0 | 2.0 | 3.0 | 3.0 | |
| | lithium hydroxide | 1.54 | 1.57 | 1.84 | 1.59 | |
| Properties: | | | | | | |
| cone penetration 25°C (JIS K2560) | | 305 | 329 | 241 | 344 | 280 |
| dropping point °C (JIS K2561) | | 199 | 196 | 200 | 195 | 198 |
| oil separation (JIS K2570) | | 2.9 | 4.7 | | 7.0 | |
| roll stability in the presence of water (AST MD1831) | | +66 | +44 | +44 | +37 | +120 |
| variability of cone penetration according to temperature (JIS K2560) | | | | | | |
| 100°C × 3Hr·UW | | +25 | +37 | | +60 | +46 |
| 150°C × 3Hr·UW | | +42 | +45 | +51 | +47 | +118 |

Table 6

| | | Example XV | Example XVI | Comparative grease composition C* |
|---|---|---|---|---|
| Compounding ratio % (by weight) | mineral oil a | 15.61 | 63.76 | |
| | mineral oil b | 31.76 | — | |
| | mineral oil c | — | 21.05 | |
| | mineral oil d | 30.67 | — | |
| | 12-hydroxystearic acid | 12.0 | 7.5 | |
| | synthetic fatty acid (C) | 4.0 | 2.5 | |
| | lithium hydroxide | 2.46 | 1.69 | |
| | aluminum stearate | 2.0 | 2.0 | |
| | antioxidant (DBPC) | 1.0 | 1.0 | |
| | Vanlube SL ** | 0.5 | 0.5 | |
| Properties: | | | | |
| cone penetration 25°C(UW) | | 240 | 250 | 263 |
| cone penetration 25°C60W (JIS K2560) | | 265 | 266 | 265 |
| dropping point °C (JIS K2561) | | 194 | 192 | 190 |
| oil separation (JIS K2570) | | 0.3 | 0.2 | 0.5 |
| roll stability in the presence of water (AST MD1831) | | +20 | +20 | +30 |
| variability of cone-penetration according to temperature (JIS K2560) | | | | |
| 80°C × 3Hr.UW | | +8 | +10 | +34 |
| 100°C × 3Hr.UW | | +10 | +18 | +48 |
| 130°C × 3Hr.UW | | +18 | +32 | +62 |
| 150°C × 3Hr.UW | | +32 | +60 | +70 |

(Remarks)
* commerical lithium grease containing 12-hydroxystearic acid
** a grease additive manufactured by R.T. Vanderbilt Co., Inc. (U.S.A.)

In the case where no aluminum stearate was added, the roll stability in the presence of water of the respective greases in Examples XV and XVI was +40, while in the case where aluminum stearate was added to the extent of 2.0%, said property was improved to be +20.

Besides, the rate of increase of cone penetration with rise in temperature was very low as compared with the comparative grease composition C.

What is claimed is:

1. A lubricating grease composition comprising a major amount of a lubricating base oil and lithium salt of a blended fatty acid prepared by mixing (a) 5 to 15% by weight, based on the weight of the grease composition, of a natural fatty acid selected from the group consisting of stearic acid and 12-hydroxystearic acid with (b) a mixture of synthetic fatty acids having 8 to 24 carbon atoms in an amount of 0.5 to 50%, based on the weight of said natural fatty acid.

2. A lubricating grease composition according to claim 1, containing aluminum stearate in an amount of from 0.5 to 5%.

3. A lubricating grease composition according to claim 1, wherein said mixture of synthetic fatty acids is a mixture of synthetic fatty acids having 8 to 16 carbon atoms.

4. A lubricating grease composition according to claim 1, wherein said mixture of synthetic fatty acids is a mixture of synthetic fatty acids having 10 to 19 carbon atoms.

5. A lubricating grease composition according to claim 1, wherein said mixture of synthetic fatty acids is a mixture of synthetic fatty acids having 10 to 24 carbon atoms.

6. A lubricating grease composition according to claim 1, wherein said natural fatty acid is stearic acid, and the amount of said mixture of synthetic fatty acids is in the range of from about 15 to about 20% by weight, based on the weight of said stearic acid.

7. A lubricating grease composition according to claim 1, wherein said natural fatty acid is 12-hydroxystearic acid, and the amount of said mixture of synthetic fatty acids is in the range of from 20 to about 30% by weight, based on the weight of said 12-hydroxystearic acid.

* * * * *